US011712104B2

(12) United States Patent
Bowman

(10) Patent No.: US 11,712,104 B2
(45) Date of Patent: Aug. 1, 2023

(54) AXIAL COMPRESSION BACKPACK SYSTEM

(71) Applicant: Wesley M. Bowman, Snowflake, AZ (US)

(72) Inventor: Wesley M. Bowman, Snowflake, AZ (US)

( * ) Notice: Subject to any disclaimer, the term of this patent is extended or adjusted under 35 U.S.C. 154(b) by 0 days.

(21) Appl. No.: 17/219,468

(22) Filed: Mar. 31, 2021

(65) Prior Publication Data

US 2021/0298459 A1 Sep. 30, 2021

Related U.S. Application Data

(60) Provisional application No. 63/002,906, filed on Mar. 31, 2020.

(51) Int. Cl.
*A45F 3/04* (2006.01)
*A45F 3/10* (2006.01)

(52) U.S. Cl.
CPC ..... *A45F 3/04* (2013.01); *A45F 3/10* (2013.01); *A45F 2200/0583* (2013.01)

(58) Field of Classification Search
CPC . A45F 3/08; A45F 3/10; A45C 7/0054; A45C 7/0095
USPC ..... 224/628, 633–636
See application file for complete search history.

(56) References Cited

U.S. PATENT DOCUMENTS 2,764,327 A * 9/1956 Stevenson ..... A45F 3/04 224/236
5,564,612 A * 10/1996 Gregory ..... A45F 3/08 224/633
7,600,619 B2 * 10/2009 Sapyta ..... A45C 13/02 190/110
8,496,149 B1 * 7/2013 Sohm ..... A45F 3/14 224/636
2002/0092882 A1 * 7/2002 Jones ..... A45F 4/02 224/636
2006/0105137 A1 * 5/2006 Kouts ..... A47D 15/003 428/99
2007/0246386 A1 * 10/2007 Nykoluk ..... A45C 13/02 206/320

* cited by examiner

*Primary Examiner* — Scott T McNurlen
(74) *Attorney, Agent, or Firm* — Snell & Wilmer L.L.P.

(57) ABSTRACT

An axial compression backpack may comprise a first panel defining a first backplane opposite a first face, a second panel coupled to a first edge of the first panel defining a second backplane opposite a second face, a third panel coupled to the first panel at a second edge opposite the first edge, the third panel defining a third backplane opposite a third face, and a cover panel coupled to the first panel orthogonal to the first edge and the second edge, wherein the cover panel defines a fourth backplane opposite a fourth face, wherein each of the second panel, the third panel, and the cover panel are configured to transition between a folded configuration and an unfolded configuration.

18 Claims, 9 Drawing Sheets

AXIAL COMPRESSION BACKPACK SYSTEM

CROSS-REFERENCE TO RELATED APPLICATIONS

This application claims priority to, and the benefit of, U.S. Provisional Application No. 63/002,906 entitled "AXIAL COMPRESSION BACKPACK SYSTEM" filed on Mar. 31, 2020. The aforementioned application is incorporated herein by reference in its entirety for all purposes.

FIELD

The disclosure relates generally to backpack systems, more specifically, to axial compression systems for backpacks and load carrying systems.

BACKGROUND

Backpacks are commonly used in recreational activities such as, hiking, climbing, skiing, camping and the like and configured to carry items such as, for example, clothing, food, water, shelter, and equipment etc. Backpacks may be used in everyday activities to carry any number of items. Conventional backpacks may employ one or more shoulder harnesses and comprise a primary compartment into which a number of items may be placed for protection and carriage. In this regard, accessing a desired item from a plurality of items contained within the primary compartment may tend to be inhibited by the protective envelope of the primary compartment and the other items contained therein.

SUMMARY

In various embodiments, an axial compression backpack comprises a first panel defining a first backplane opposite a first face, a second panel coupled to a first edge of the first panel defining a second backplane opposite a second face, a third panel coupled to the first panel at a second edge opposite the first edge, the third panel defining a third backplane opposite a third face, and a cover panel coupled to the first panel orthogonal to the first edge and the second edge, wherein the cover panel defines a fourth backplane opposite a fourth face, wherein each of the second panel, the third panel, and the cover panel are configured to transition between a folded configuration and an unfolded configuration, wherein the second panel is configured to fold across the first panel, the third panel is configured to fold across the second panel, and the cover panel is configured to fold across the first panel, the second panel, and the third panel.

In various embodiments, each of the first face, the second face, the third face, and the fourth backplane are exposed in the unfolded configuration. In various embodiments, wherein in response to transitioning from the unfolded configuration to the folded configuration, the first face is disposed proximate the second face, the third face is disposed proximate the second backplane, and the fourth backplane is disposed proximate the third backplane. In various embodiments, the first panel includes a hydration system pocket disposed between the first backplane and the first face. In various embodiments, the first backplane includes a coupling portion configured to couple to a backpack frame. In various embodiments, at least one of the first face, the second face, and the third face comprise a first pocket.

In various embodiments, at least one of the first face, the second face, and the third face comprise a second pocket and a third pocket, wherein the second pocket is larger than the first pocket and the third pocket is larger than the second pocket. In various embodiments, the first face comprises a bedroll retention strap. In various embodiments, the fourth face comprises a zippered pocket. In various embodiments, each of the second panel, the third panel, and the cover panel are stitched to the first panel to form a flexible array of panels. In various embodiments, each of the first panel, the second panel, the third panel are monolithic. In various embodiments, at least one of the first face, the second face, the third face, or the fourth face comprise an interlocking attachment system for removably securing objects to the respective face.

In various embodiments a load bearing system may comprise a pack frame configured to distribute a load, and an axial compression backpack coupled to the pack frame and configured to receive the load, comprising a first panel defining a first backplane opposite a first face, a second panel coupled to a first edge of the first panel defining a second backplane opposite a second face, a third panel coupled to the first panel at a second edge opposite the first edge, the third panel defining a third backplane opposite a third face, and a cover panel coupled to the first panel orthogonal to the first edge and the second edge, wherein the cover panel defines a fourth backplane opposite a fourth face, wherein each of the second panel, the third panel, and the cover panel are configured to transition between a folded configuration and an unfolded configuration, wherein the second panel is configured to fold across the first panel, the third panel is configured to fold across the second panel, and the cover panel is configured to fold across the first panel, the second panel, and the third panel.

In various embodiments, each of the first face, the second face, the third face, and the fourth backplane are exposed in the unfolded configuration, and wherein in response to transitioning from the unfolded configuration to the folded configuration, the first face is disposed proximate the second face, the third face is disposed proximate the second backplane, and the fourth backplane is disposed proximate the third backplane. In various embodiments, the first panel includes a hydration system pocket disposed between the first backplane and the first face, and wherein at least one of the first face, the second face, and the third face comprise a first pocket. In various embodiments, at least one of the first face, the second face, and the third face comprise a second pocket and a third pocket wherein the second pocket is larger than the first pocket and the third pocket is larger than the second pocket. In various embodiments, the fourth face comprises a zippered pocket. In various embodiments, the first face comprises a bedroll retention strap. In various embodiments, each of the first panel, the second panel, the third panel are monolithic. In various embodiments, at least one of the first face, the second face, the third face, or the fourth face comprise an interlocking attachment system for removably securing objects to the respective face.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosures, it should be understood that other embodiments may be realized and that logical, chemical, and mechanical changes may be made without departing from the spirit and scope of the disclosures. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact.

The use of terms such as "above," "below," "upper," "lower," "forward," "aft", "inboard", "outboard", "dorsal", "ventral" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 1:
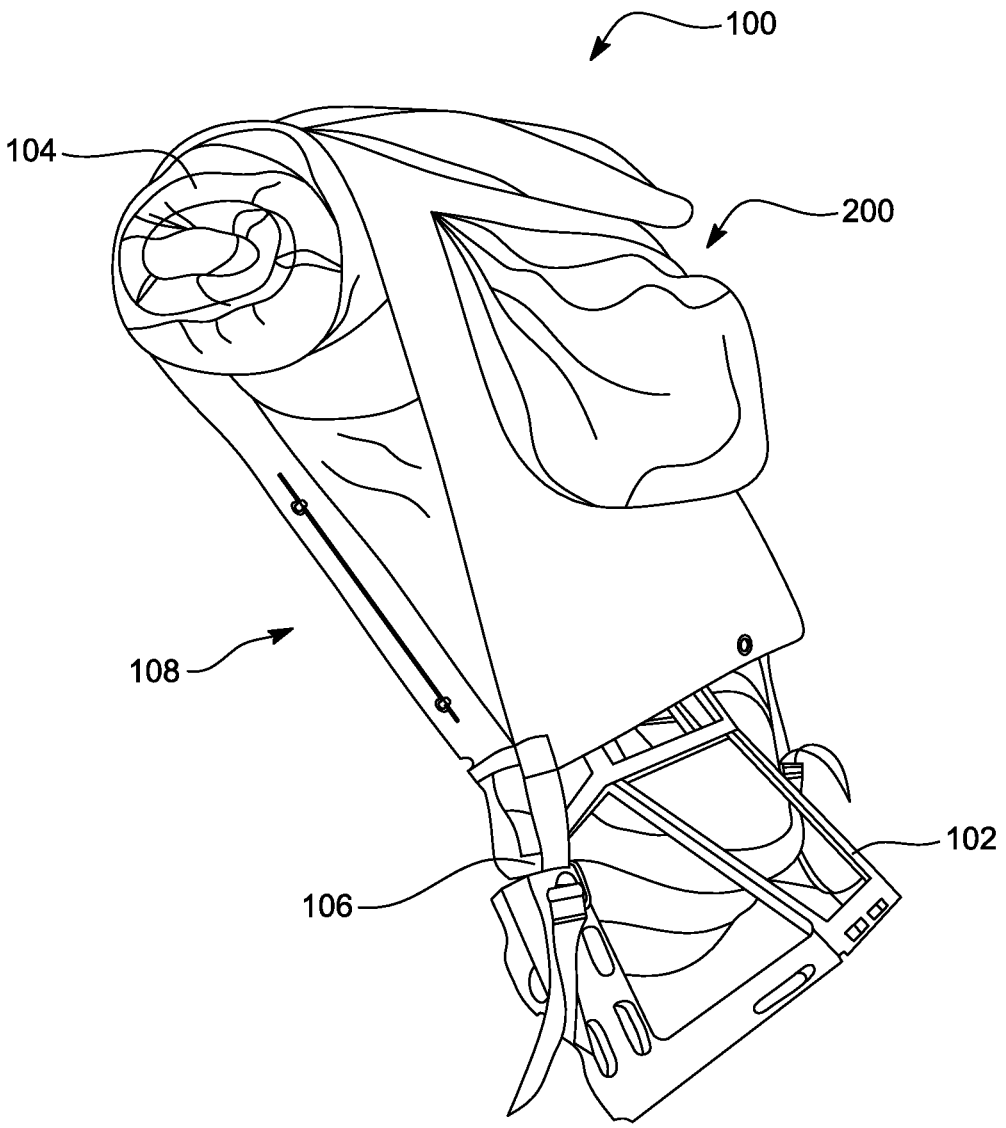
FIG. 1 illustrates a load bearing system, in accordance with various embodiments.

In various embodiments and with reference to FIG. 1, a load bearing system 100 is illustrated comprising a pack frame 102 and an axial compression backpack 200 (i.e. backpack). Backpack 200 may be configured to retain and receive a load 104 such as, for example, a bedroll, clothing, food, water, shelter, and/or any number of other items. Pack frame 102 may be configured to distribute the load 104 retained by backpack 200. For example the pack frame 102 may comprise a hip belt 106 coupled to the pack frame 102 and or shoulder straps 108 (not shown) which may be coupled to the pack frame 102 and or the backpack 200.

Figure 2A:
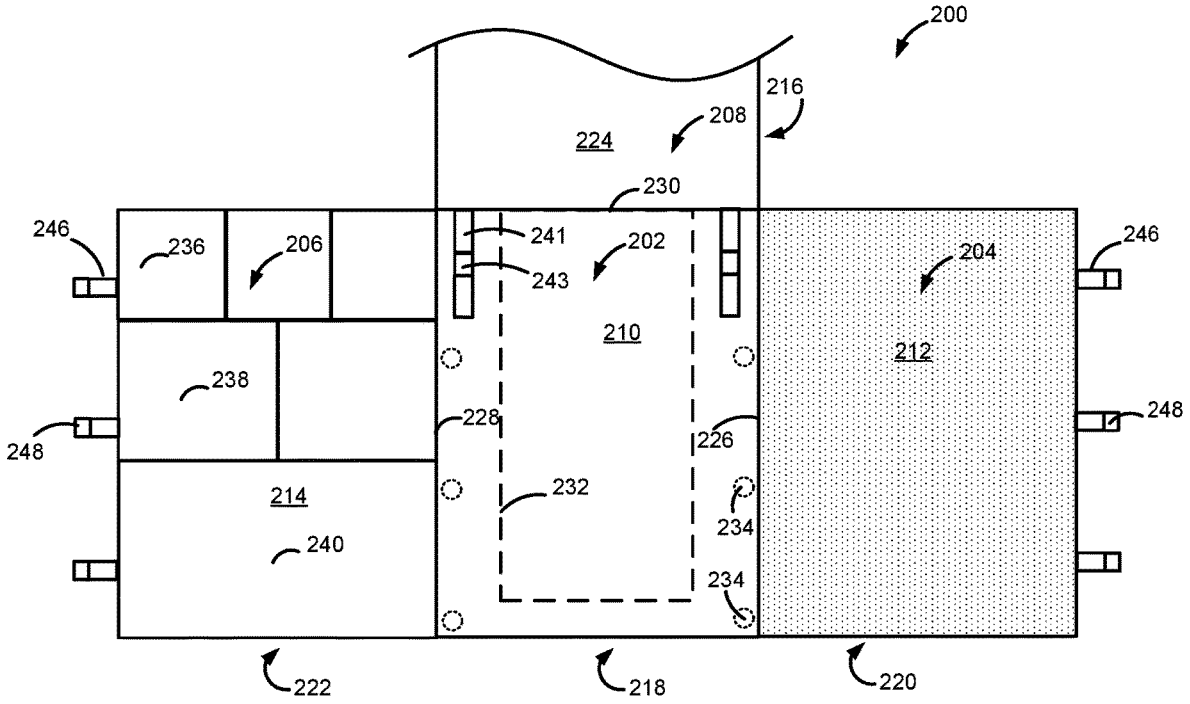
FIG. 2A illustrates an axial compression backpack of a load bearing system, in accordance with various embodiments.
Figure 2B:
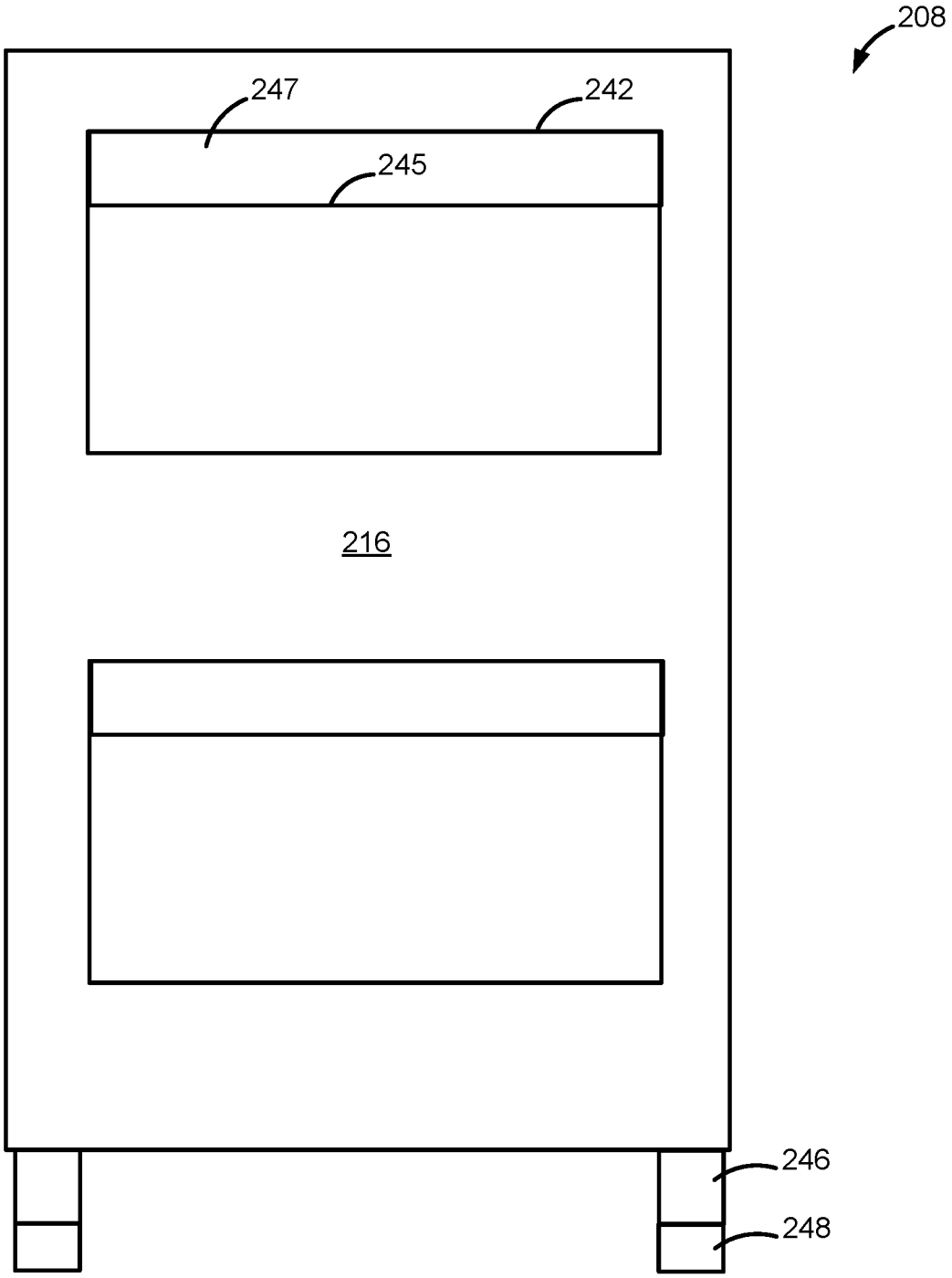
FIG. 2B illustrates an axial compression backpack of a load bearing system, in accordance with various embodiments.

In various embodiments and with additional reference to FIGS. 2A and 2B, backpack 200 is illustrated in an unfolded configuration laid flat in plane with the page. Backpack 200 comprises a first panel 202, a second panel 204, and a third panel 206, and a cover panel 208. Each of the panels (202, 204, 206, 208) may define a respective face and backplane opposite the face. The first panel 202 defines a first face 210, the second panel 204 defines a second face 212, the third panel 206 defines a third face 214, and the cover panel 208 defines a fourth face 216 (FIG. 2B). In like regard, the first panel 202 defines a first backplane 218 (not shown), the second panel 204 defines a second backplane 220 (not shown), the third panel 206 defines a third backplane 222 (not shown), and the cover panel defines 206 a fourth backplane 224. In this regard FIG. 2A is viewed toward the respective faces (210, 212, 214) of panels (202, 204, 206) and the fourth backplane 224 of the cover panel 208. In various embodiments, faces (210, 212, 214) of panels (202, 204, 206) and the fourth backplane 224 are exposed in response to transitioning the backpack 200 from a folded configuration to the unfolded configuration.

The first panel 202 further defines a first edge 226 and a second edge 228 opposite the first edge 226. The second panel 204 may be coupled to the first panel 202 along the first edge 226. The third panel 206 may be coupled to the first panel along the second edge 228. In various embodiments, the first panel 202 may further define a third edge 230. The cover panel 208 may be coupled to the first panel 202 orthogonally to the first edge 226 and the second edge 228 along the third edge 230 of the first panel 202.

In various embodiments, each of the panels (202, 204, 206, 208) may comprise a flexible and/or fabric material such as, for example, a natural fabric, a synthetic fabric, canvas, denim, duck, nylon, acrylic, polyester, aramid, para-aramid, ultra high molecular weight polyethylene, and/or any other suitable material. In various embodiments, each of the second panel 204, the third panel 206, and the cover panel 208 may be coupled to the first panel 202 to form a flexible array of panels. For example, the panels (204, 206, 208) may be coupled to the first panel 202 via boding, stitching, welding, riveting, lashing, and/or the like. In various embodiments, the panels (204, 206, 208) may be removably coupled to the first panel 202 by a removable coupling such as, for example via, zippers, snaps, buckling, lashing, and/or the like. In various embodiments, each of the first panel 202, the second panel 204, the third panel 206 and/or the cover panel 208 may be monolithic.

In various embodiments, the first panel 202 includes a hydration system pocket 232 disposed between the first face 210 and the first backplane 218. The first panel 202 may also include a coupling portion configured to couple the backpack 200 to the pack frame 102. The coupling portion may be defined by a plurality of grommets 234 configured to interface with corresponding studs of the pack frame 102. In various embodiments, the coupling portion may enable removable coupling between the backpack 200 and the pack frame 102. In various embodiments, the coupling portion may be internal to the first panel 202. In like regard, the pack frame 102 may be internal to the first panel 202.

In various embodiments, any of the faces (210, 212, 214, 216) may comprise an interlocking attachment system for removably securing objects to the respective face such as, for example, hook-and-loop, slidingly-engaging-fastener, webbing, magnetic, Pouch Attachment Ladder System (PALS), and/or the like. For example the second face 212 of the second panel 204 may comprise a PALS grid across the indicated shaded area. Any of the faces (210, 212, 214, 216) may include straps, lashing, ties, etc. and/or associated fittings for load retention and compression such as for example, a bedroll retention strap 241 and side squeeze buckle fitting 243. The fittings may include any suitable fitting such as, for example, ladder lock, slide lock, squeeze-type, cam lock, cinch, buckle, clasp, friction, hook and loop, snap, and/or the like.

In like regard, the outer edges of the second panel 204, the third panel 206, and the cover panel 208 may include associated straps 246, lashing, ties, etc. and/or and fittings 248 to permit coupling of the panel edges and compression of a load axially transverse to the respective straps. In this regard, backpack 200 and each of the second panel 204, the third panel 206, and the cover panel 208 are configured to transition between a folded configuration and the unfolded configuration. The panel straps 246 and fittings 248 may tend to enable axial compression of a carried load along an axis defined parallel to the first edge 226 and the second edge 228 and transverse to the third edge 230. Stated another way, transitioning backpack 200 between the unfolded configuration and the folded configuration tends to axially compress the backpack 200 and the carried load. In this regard, backpack 200 may be of a variable volume which may adjustably expand or contract to accommodate variations in size and contour of the carried load. In various embodiments, the volume may vary between 20 liters and 200 liters. In various embodiments the panel straps 246 and fittings 248 may tend to enable the variable volume by adjusting the circumference coupled panels when backpack 200 is in the folded configuration.

In various embodiments, any of the faces (210, 212, 214, 216) may comprise a pocket or a plurality of pockets. For example, in various embodiments, the third face 214 may comprise a first pocket 236, a second pocket 238, and a third pocket 240. In various embodiments, the second pocket 238 is larger than the first pocket 236 and the third pocket 240 is larger than the second pocket 238. Any of the pockets may include a closure such as, for example, a drawstring, a snap, a zipper, and/or the like. For example, in various embodiments, the fourth face 216 may include a zippered pocket 242 which may be closed along flap 247 by a zipper 245.

Figure 3A:
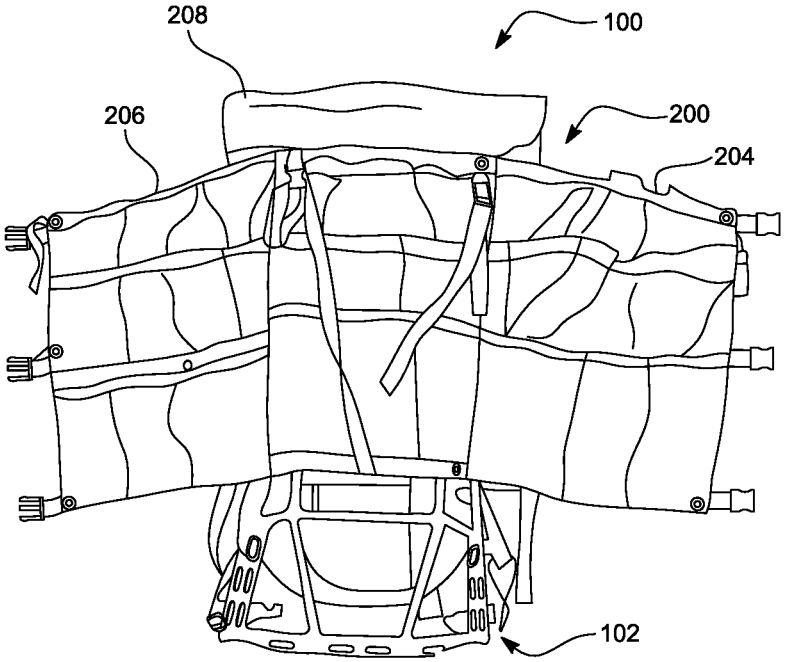
FIG. 3A illustrates an axial compression backpack in an unfolded condition, in accordance with various embodiments.

In various embodiments and with additional reference to FIG. 3A, load bearing system 100 is illustrated with backpack 200 in the unfolded configuration. The second panel 204 and the third panel 206 are spread open and away from the face 210 of the first panel 202. The cover panel 208 is folded over the third edge 230 of the first panel 202 such that the first backplane 218 lies proximate the fourth face 216.

Figure 3B:
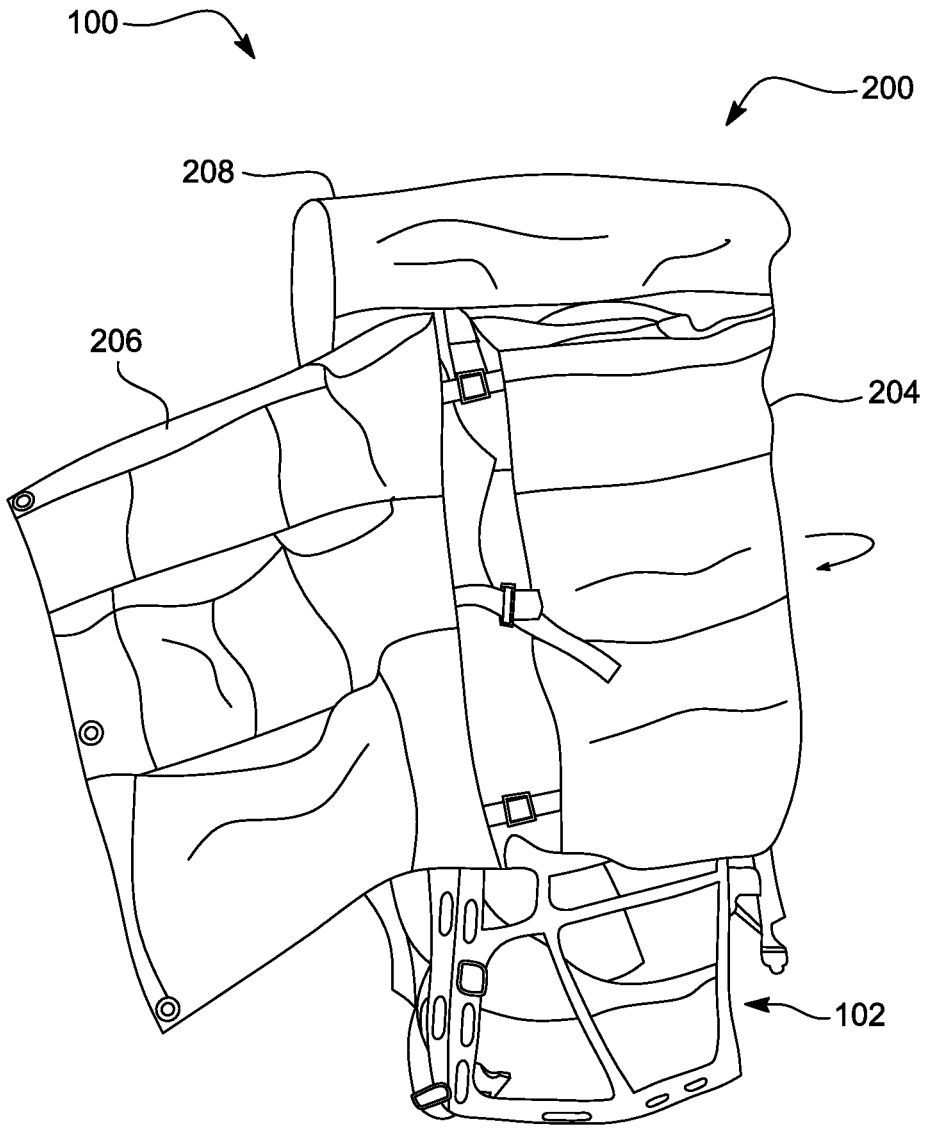
FIG. 3B illustrates a first transition state of an axial compression backpack, in accordance with various embodiments.

In various embodiments and with additional reference to FIG. 3B, load bearing system 100 is illustrated with backpack 200 in a first transition state between the unfolded the folded configuration. The second panel 204 is folded (indicated by the arrow) across the first panel 202 along the first edge 226. The outer edge of the second panel 204 may be coupled via the straps 246 at the second edge 228. In this regard, the second panel 204 may be releasably secured at an internal point along the second edge 228. For example, the second panel 204 may be coupled such that second face 212 is disposed proximate the first face 210. In this configuration, the straps 246 at the second edge 228 may be cinched down tending thereby to axially compress a carried load between the second face 212 and the first face 210.

Figure 3C:
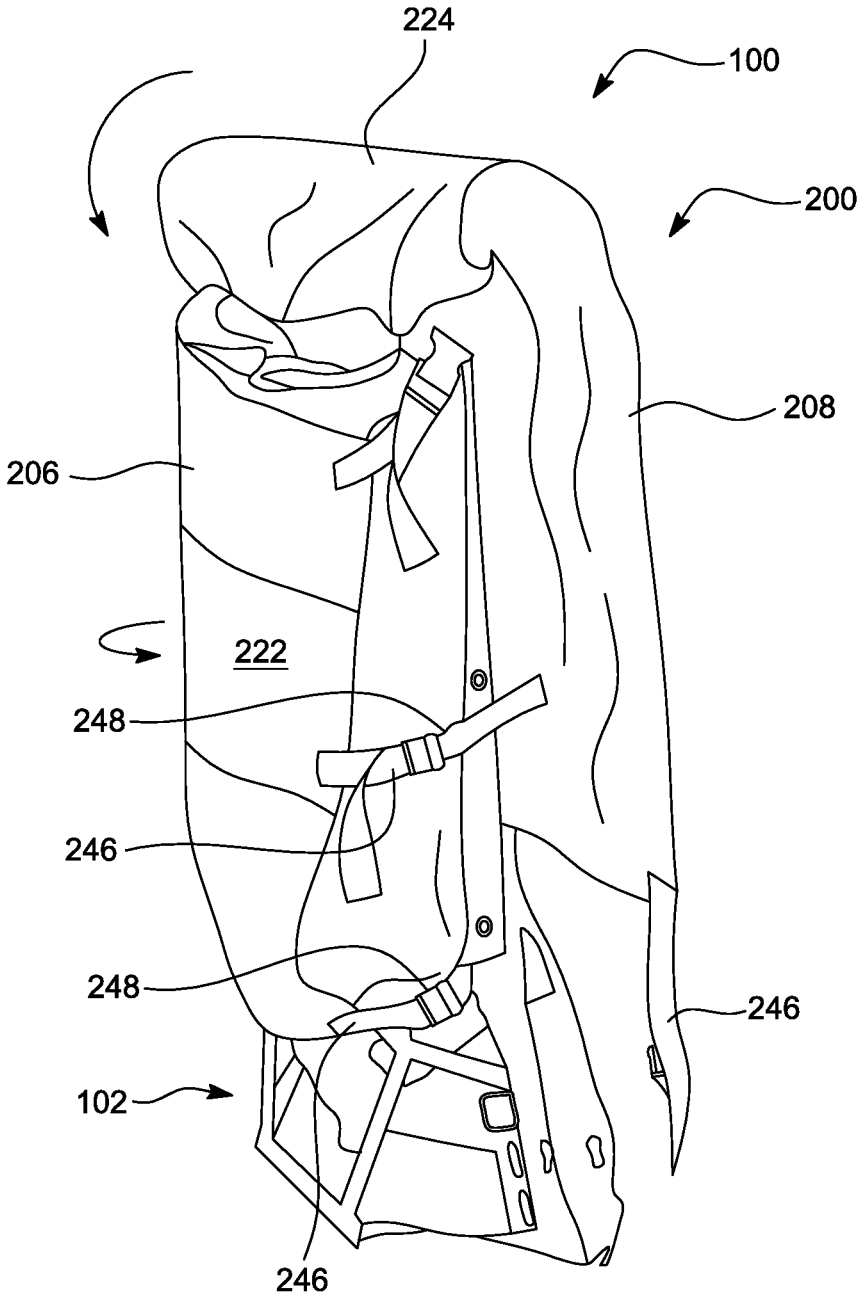
FIG. 3C illustrates a second transition state of an axial compression backpack, in accordance with various embodiments.

In various embodiments and with additional reference to FIG. 3C, load bearing system 100 is illustrated with backpack 200 in a second transition state between the unfolded the folded configuration. The third panel 206 is folded (indicated by arrow) along the second edge 228 across the coupled second panel 204 and first panel 202. The outer edge of the third panel 206 may be coupled at the first edge 226 to the first panel 202. In this regard, the third panel 206 may be releasably secured at an external point along the first edge 226. For example, the third panel may be coupled via the straps 246 such that the third face 214 is disposed proximate the second backplane 220. In this configuration, the straps 246 at the first edge 226 may be cinched down tending thereby to axially compress a carried load between the third face 214 and the second backplane 220.

The cover panel 208 is folded along the third edge 230 over the first panel 202, the second panel 204, and the third panel 206 such that fourth backplane 224 is disposed proximate the third backplane 222. The straps 246 at the outer edge of the cover panel 208 may then be coupled to the first panel 202 or the pack frame 102 thereby completing the transition to the folded configuration illustrated in FIG. 1.

In operation of backpack 200 and when in the folded configuration, pockets (e.g., zippered pocket 242) of the fourth face 216 may be accessible. These pockets may be useful for holding items that are more readily accessed during the backpacking trip, such as a flashlight, sunscreen and a lunch. Thus, these pockets on the fourth face 216 may facilitate access to stored contents without unfolding the backpack. The folded configuration may tend to protect the faces (210, 212, 214) of the respective panels when transporting the backpack 200. In the unfolded configuration, backpack 200 may be arrayed as shown in FIG. 2A and laid flat upon a surface to facilitate ease of access to the faces (210, 212, 214).

Figure 4:
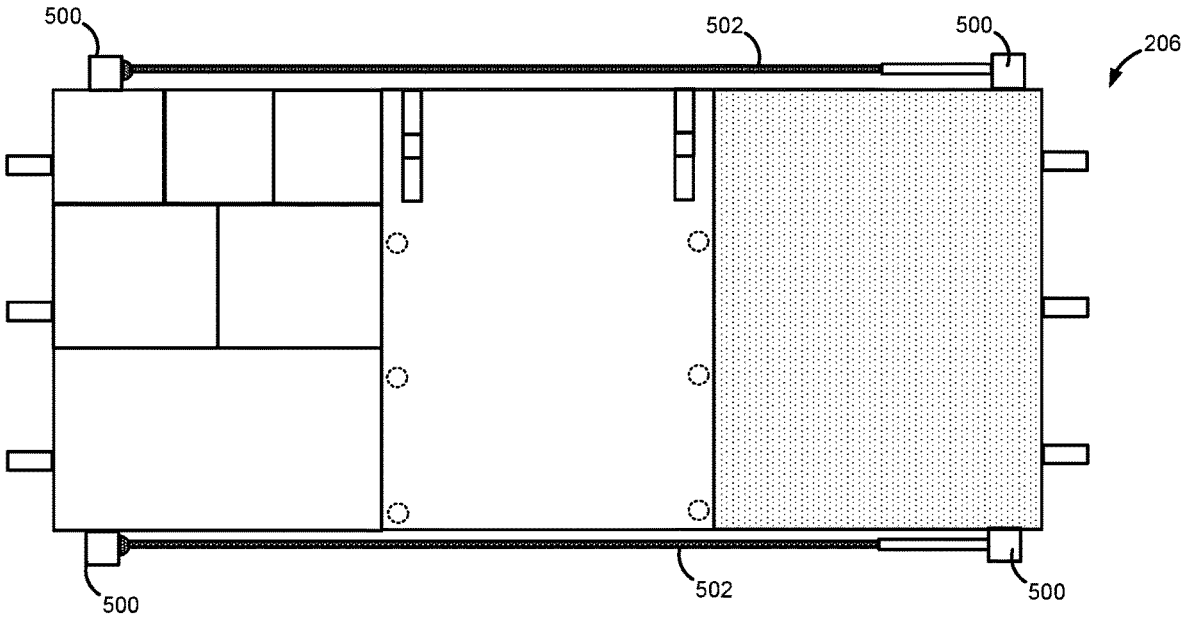
FIG. 4 illustrates an auxiliary coupling portion of an axial compression backpack, in accordance with various embodiments.

In various embodiments and with additional reference to FIG. 4, an auxiliary coupling portion 500 of backpack 200 is illustrated. The auxiliary coupling portion 500 may enable coupling of the backpack 200 to one or more rigid objects 502, such as, for example, hiking poles. In an example embodiment, the rigid objects 502 may be telescoping (such as with collapsible hiking poles) to place the panel in tension between the coupling portions 500. The auxiliary coupling portion 500 may be arrayed about the perimeter of the panels (202, 204, 206). In this regard, coupling the rigid objects 502 at the auxiliary coupling portion 500 may, in response, place the panels (202, 204, 206) in tension. In various embodiments, placing the panels (202, 204, 206) in tension may tend to inhibit transition of the backpack 200 from the unfolded configuration to the folded configuration. In this regard, the auxiliary coupling portions 500 may facilitate ease of access to the faces (210, 212, 214). For example, a backpacker may put the panels in an unfolded configuration with the panels held wide, such that access to the pockets is convenient and such that the panels do not sag or lie in the dirt.

Figure 5A:
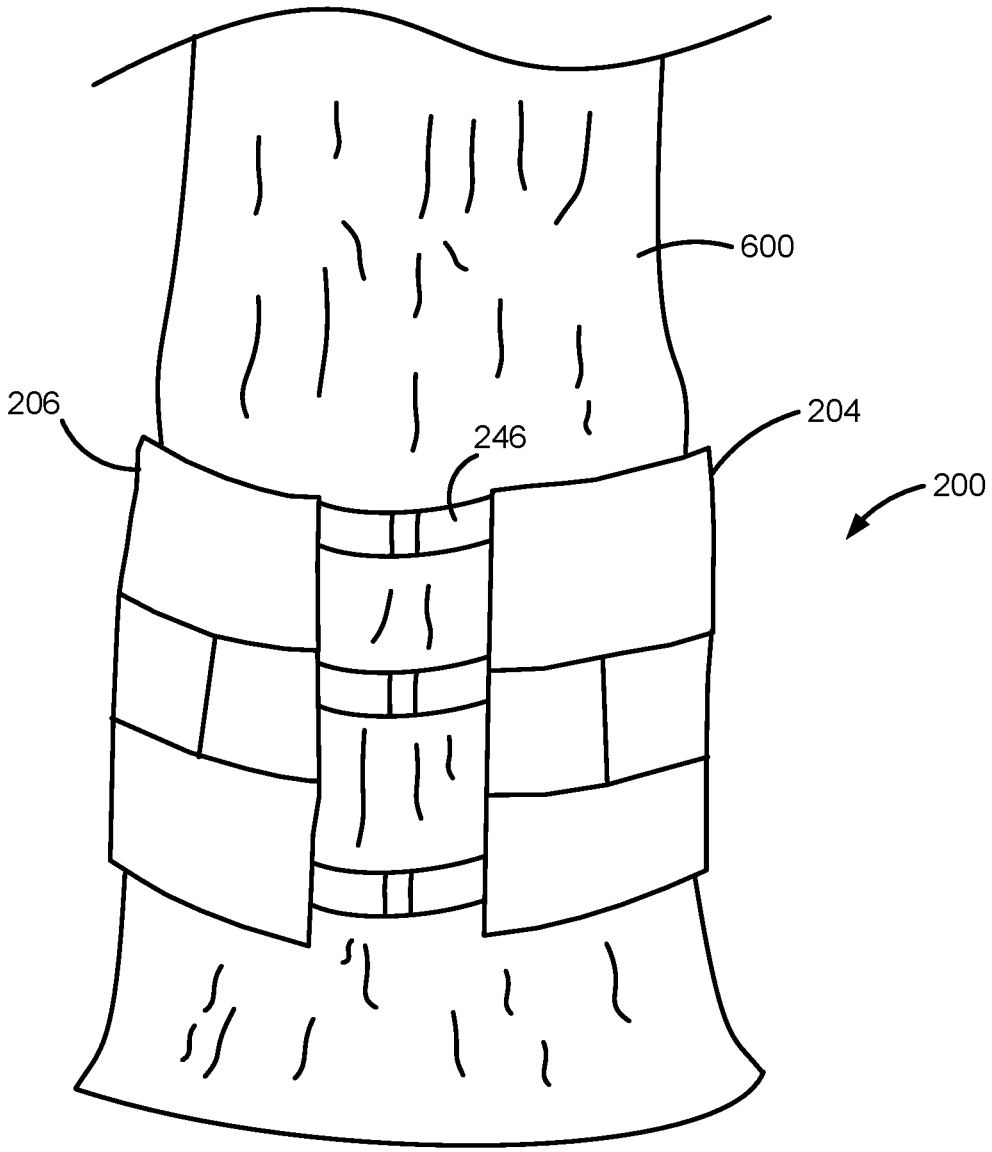
FIG. 5A illustrates an axial compression backpack coupled about an object, in accordance with various embodiments.

In various embodiments and with additional reference to FIG. 5A, backpack 200 is shown coupled about an object 600 such as, for example, a tree. The backpack 200 may be configure to couple about an object to facilitate ease of access to the faces (210, 212, 214). Backpack 200 may be wrapped circumferentially about the object 600 with the faces (210, 212, 214) of the respective panels (202, 204, 206) oriented away from the object 600. Stated another way, the respective backplanes of the panels (202, 204, 206) are contacted with the object 600. The straps 246 of the second panel 204 may be coupled to the straps 246 of the third panel 206 thereby coupling the backpack 200 about the object 600. In this regard, coupling the backpack 200 about the object 600 may tend to secure the panels (202, 204, 206) to the object 600. The object 600 may thereby provide a rigid surface tending to facilitate ease of access to the faces (210, 212, 214).

Figure 5B:
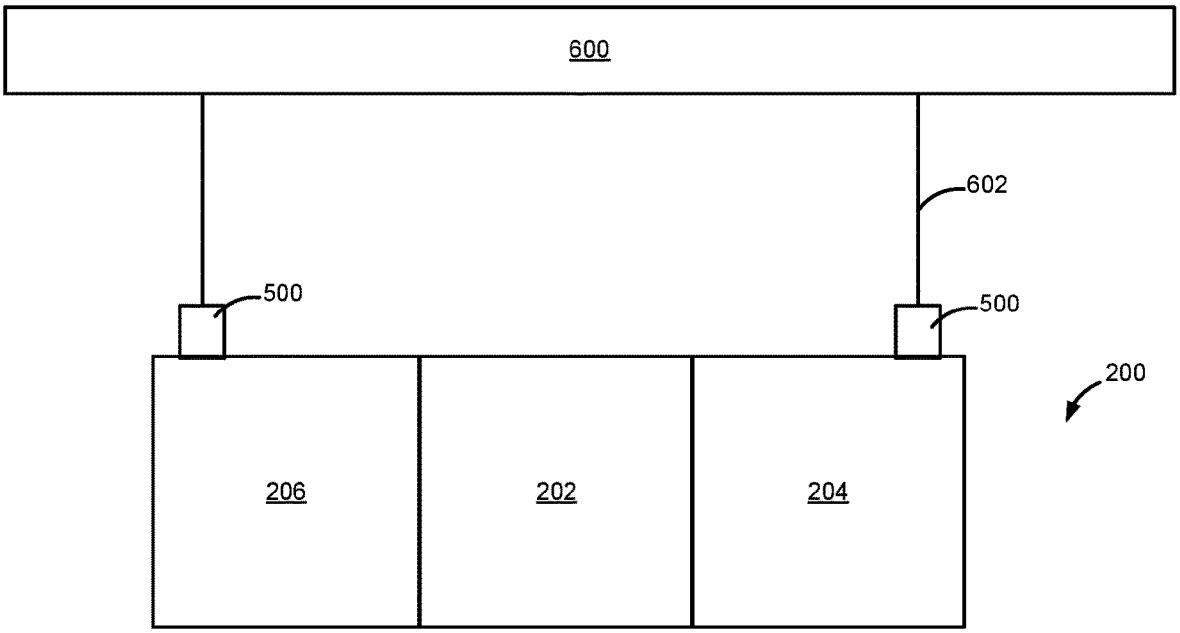
FIG. 5B illustrates an axial compression backpack suspended from an object, in accordance with various embodiments.

In various embodiments and with additional reference to FIG. 5B, backpack 200 is shown suspended from an object 600 such as, for example, a tree limb. Backpack 200 may be configured to be suspended to inhibit contact with the ground, to enhance protection of the contents of backpack 200 from small animals, or to improve access to the contents of the pack by placing it at a desired height above the surface of the ground. The auxiliary coupling portion 500 may enable suspension of the backpack 200 from the object 600 such as, for example, coupling via lashing 602. In various embodiments, the auxiliary coupling portion 500 may enable simultaneous coupling to the rigid objects 502 and the lashing 602. Thereby, the auxiliary coupling portion 500 may place the panels (202, 204, 206) in tension while in suspension from the object 600. In this regard, the auxiliary coupling portion 500 of backpack 200 may facilitate ease of access to the faces (210, 212, 214) and inhibit contact of the backpack 200 with the ground. Moreover, any suitable number of coupling portions 500 may be used.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures.

The scope of the disclosures is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiment Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An axial compression backpack comprising:

a backpack frame;

a first panel defining a first backplane opposite a first face, the first backplane coupled to the backpack frame;

a second panel coupled to a first edge of the first panel defining a second backplane opposite a second face;

a third panel coupled to the first panel at a second edge opposite the first edge, the third panel defining a third backplane opposite a third face; and a cover panel coupled to the first panel orthogonal to the first edge and the second edge, wherein the cover panel defines a fourth backplane opposite a fourth face, wherein each of the second panel, the third panel, and the cover panel are configured to transition between a folded configuration and an unfolded configuration, wherein the second panel is configured to fold across the first panel, the third panel is configured to fold across the second panel, and the cover panel is configured to fold across the first panel, the second panel, and the third panel, wherein in response to transitioning from the unfolded configuration to the folded configuration, the first face is disposed proximate the second face and the second panel is coupled at an internal point along the second edge, the third face is disposed proximate the second backplane and the third panel is coupled at an external point along the first edge, and the fourth backplane is disposed proximate the third backplane, wherein in a partially unfolded configuration, the cover panel is unfolded fully exposing the fourth backplane, and the third panel is uncoupled and unfolded fully exposing the third face, but the second panel remains coupled with the second face disposed proximate the first face, wherein the axial compression backpack is bottomless, such that in the folded configuration a bottom portion of the axial compression backpack is open, the bottom portion being located opposite where the cover panel is connected to the first panel, wherein the axial compression backpack does not comprise a fourth panel connected to the first panel opposite from where the cover panel is connected to the first panel, and wherein in the folded configuration the cover panel is configured to be coupled to the first panel on one end and secured to the backpack frame on the other end.

2. The axial compression backpack of claim 1, wherein each of the first face, the second face, the third face, and the fourth backplane are exposed in the unfolded configuration.

3. The axial compression backpack of claim 1, wherein the first panel includes a hydration system pocket disposed between the first backplane and the first face.

4. The axial compression backpack of claim 1, wherein the first backplane includes a coupling portion configured to couple to the backpack frame.

5. The axial compression backpack of claim 1, wherein at least one of the first face, the second face, and the third face comprise a first pocket.

6. The axial compression backpack of claim 5, wherein at least one of the first face, the second face, and the third face comprise a second pocket and a third pocket, wherein the second pocket is larger than the first pocket and the third pocket is larger than the second pocket.

7. The axial compression backpack of claim 1, wherein the first face comprises a bedroll retention strap.

8. The axial compression backpack of claim 1, wherein the fourth face comprises a zippered pocket.

9. The axial compression backpack of claim 1, wherein each of the second panel, the third panel, and the cover panel are stitched to the first panel to form a flexible array of panels.

10. The axial compression backpack of claim 1, wherein each of the first panel, the second panel, and the third panel are monolithic.

11. The axial compression backpack of claim 1, wherein at least one of the first face, the second face, the third face, or the fourth face comprise an interlocking attachment system for removably securing objects to the respective face.

12. The axial compression backpack of claim 1, wherein the first panel includes a hydration system pocket disposed between the first backplane and the first face, and wherein at least one of the first face, the second face, and the third face comprise a first pocket.

13. The axial compression backpack of claim 12, wherein at least one of the first face, the second face, and the third face comprise a second pocket and a third pocket, wherein the second pocket is larger than the first pocket and the third pocket is larger than the second pocket.

14. The axial compression backpack of claim 13, wherein the fourth face comprises a zippered pocket.

15. A load bearing system, comprising:

a pack frame configured to distribute a load; and an axial compression backpack coupled to the pack frame and configured to receive the load, comprising:

a first panel defining a first backplane opposite a first face;

a second panel coupled to a first edge of the first panel defining a second backplane opposite a second face;

a third panel coupled to the first panel at a second edge opposite the first edge, the third panel defining a third backplane opposite a third face; and a cover panel coupled to the first panel orthogonal to the first edge and the second edge, wherein the cover panel defines a fourth backplane opposite a fourth face, wherein each of the second panel, the third panel, and the cover panel are configured to transition between a folded configuration and an unfolded configuration, wherein the second panel is configured to fold across the first panel, the third panel is configured to fold across the second panel, and the cover panel is configured to fold across the first panel, the second panel, and the third panel, wherein in response to transitioning from the unfolded configuration to the folded configuration, the first face is disposed proximate the second face and the second panel is coupled at an internal point along the second edge, the third face is disposed proximate the second backplane and the third panel is coupled at an external point along the first edge, and the fourth backplane is disposed proximate the third backplane, wherein in a partially unfolded configuration, the cover panel is unfolded fully exposing the fourth backplane, and the third panel is uncoupled and unfolded fully exposing the third face, but the second panel remains coupled with the second face disposed proximate the first face, wherein the axial compression backpack is bottomless, such that in the folded configuration a bottom portion of the axial compression backpack is open, the bottom portion being located opposite where the cover panel is connected to the first panel, wherein the axial compression backpack does not comprise a fourth panel connected to the first panel opposite from where the cover panel is connected to the first panel, and wherein in the folded configuration the cover panel is configured to be coupled to the first panel on one end and secured to the frame of the backpack on the other end.

16. The axial compression backpack of claim 15, wherein the first face comprises a bedroll retention strap.

17. The axial compression backpack of claim 15, wherein each of the first panel, the second panel, and the third panel are monolithic.

18. The axial compression backpack of claim 15, wherein at least one of the first face, the second face, the third face, or the fourth face comprise an interlocking attachment system for removably securing objects to the respective face.

* * * * *